United States Patent [19]

Fulk

[11] 4,084,804

[45] Apr. 18, 1978

[54] METHOD AND APPARATUS FOR PRODUCING WEB UNITS

[75] Inventor: James B. Fulk, P.O. Box 947, Los Gatos, Calif. 95030

[73] Assignee: James B. Fulk, Los Gatos, Calif.

[21] Appl. No.: 740,034

[22] Filed: Nov. 8, 1976

[51] Int. Cl.[2] ..... B65H 45/00

[52] U.S. Cl. ..... 270/52.5

[58] Field of Search ..... 270/52.5, 61 F, 79

[56] References Cited

U.S. PATENT DOCUMENTS

| | | | |
|---|---|---|---|
| 2,975,989 | 3/1961 | Hinman | 270/52.5 |
| 3,143,342 | 8/1964 | Pine | 270/52.5 |
| 3,170,685 | 2/1965 | Biggar | 270/61 F |

*Primary Examiner*—Edgar S. Burr
*Assistant Examiner*—A. Heinz
*Attorney, Agent, or Firm*—Teare, Teare & Sammon

[57] ABSTRACT

A method and apparatus for producing a plurality of web units, such as business forms, on a single machine. A plurality of paper webs are simultaneously processed while they are moving through the machine in superposed relationship and in a direction which is common to all of them. The webs are then separated, and their direction of movement is changed to one which is normal to the direction of movement through the machine. The webs are further processed after the direction of movement has been changed as by cross-perforating and folding and by forming them into separate stacks at the front of the machine.

4 Claims, 4 Drawing Figures

METHOD AND APPARATUS FOR PRODUCING WEB UNITS

BACKGROUND OF THE INVENTION

The present invention relates to a method and apparatus for making business forms by moving superimposed webs of paper through a machine, simultaneously processing the webs while they are moving in a common direction and then separating the webs into units and further processing them as by zigzag folding or by cutting into separate forms. One method heretofore devised and known as a "two-wide" folder is illustrated in Letters Patent in U.S. Pat. No. 3,596,899 which was issued to me on Aug. 3, 1971. In such patent, the webs, after being processed, are separated laterally at a point between the end of the machine on which the webs have been processed and a machine, such as a folder, where the webs are zigzag folded into separate stacks. Such method and apparatus require a location of the folding machines at the end of the processing machine, thereby increasing the overall length of the apparatus and rendering it difficult for an operator, who is normally stationed at the front of the machine, to attend to the removal of the stacks without interrupting the continuous operation of the equipment.

SUMMARY OF THE INVENTION

The present invention provides a method and apparatus which enables the webs to be separated and then processed as by cross-perforating and by folding into as many stacks as the machine is capable of processing. The invention is carried out by changing the direction of travel of the webs to one which is normal to the direction of travel of the webs through the processing machine and then further processing the webs, such as by cross-perforating, by zigzag folding and forming the folded webs into stacks, which are located at the front of the machine and adjacent to each other and in close proximity to the end of the processing machine. Thus, the operator can make adjustments on the processing machine, and at the same time can conveniently service the stacks, as required.

DESCRIPTION OF THE PREFERRED EMBODIMENTS

Figure 1:
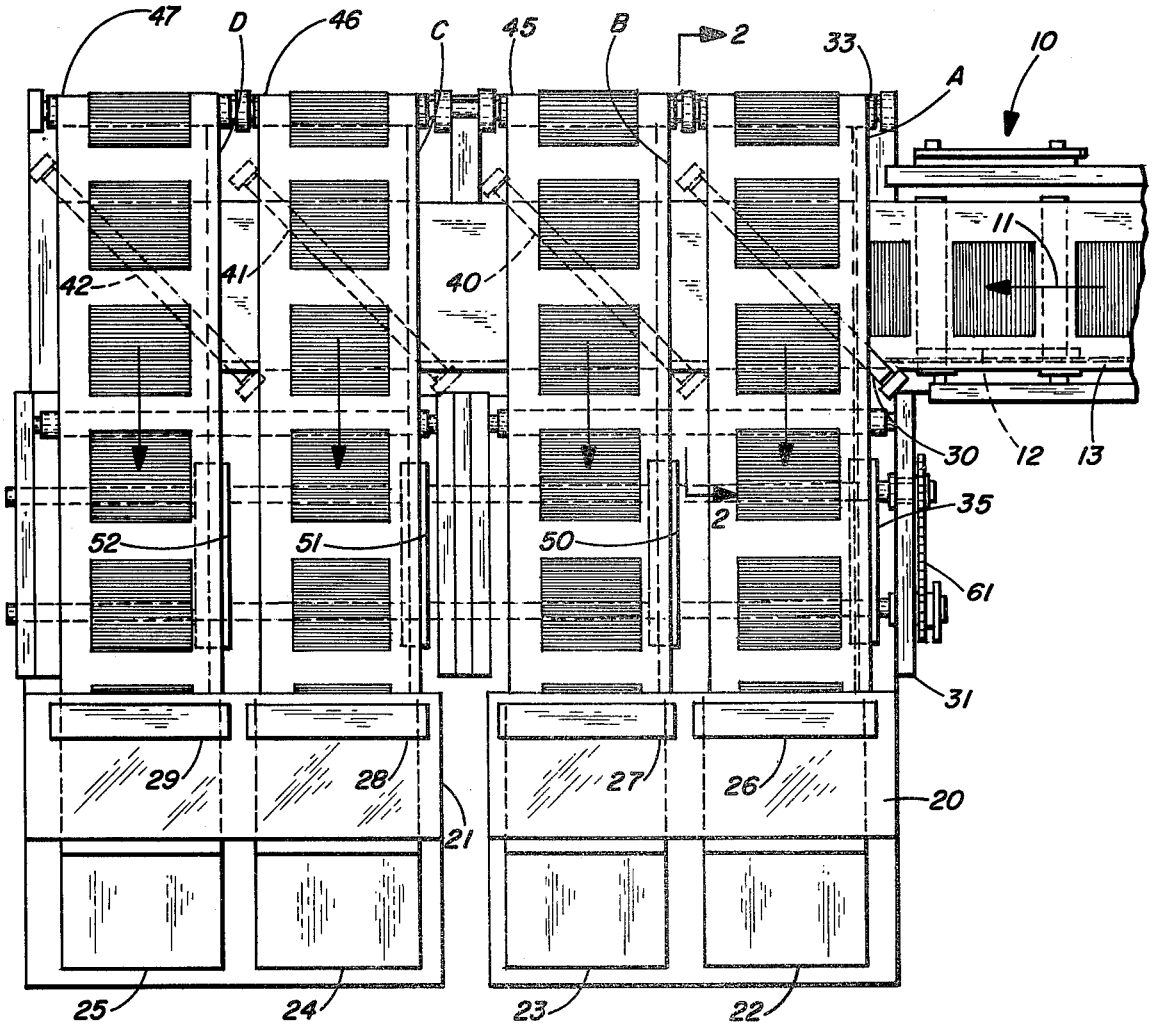
FIG. 1 is a fragmentary top plan view of a part of a printing press adjacent the delivery end thereof and illustrating one method and apparatus for carrying out the present invention.
Figure 2:
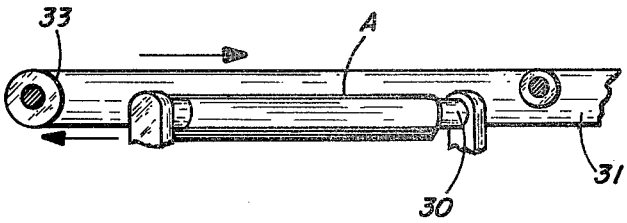
FIG. 2 is a vertical section taken on a plane indicated by line 2—2 of FIG. 1.
Figure 3:
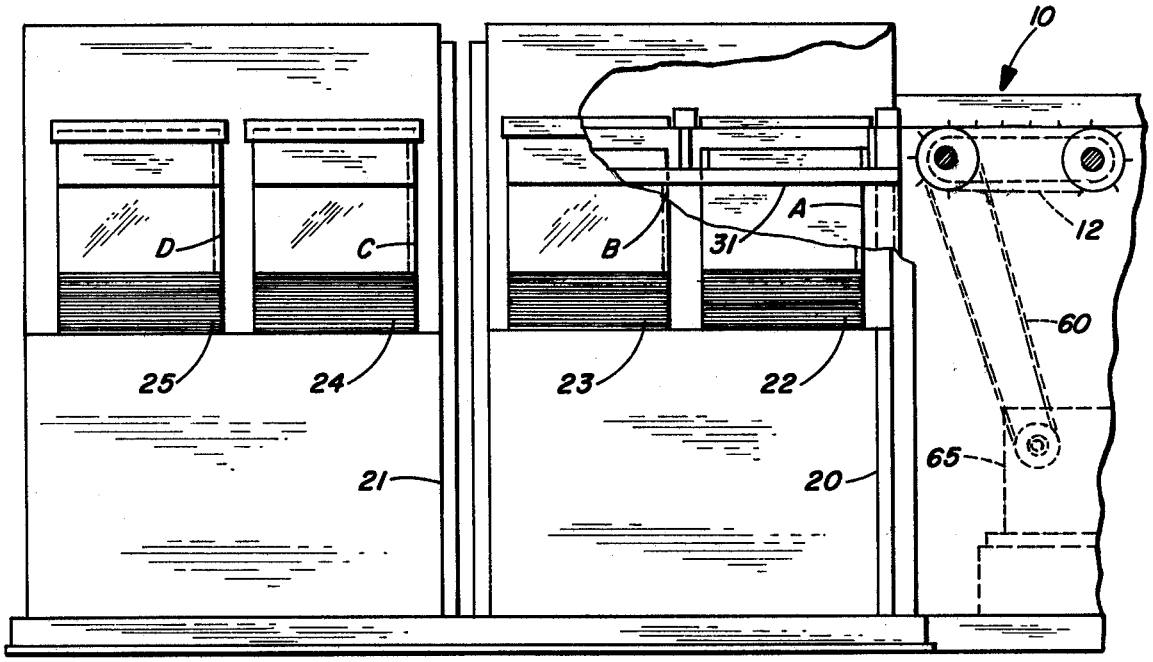
FIG. 3 is a fragmentary front elevational view of the apparatus shown in FIG. 1.
Figure 4:
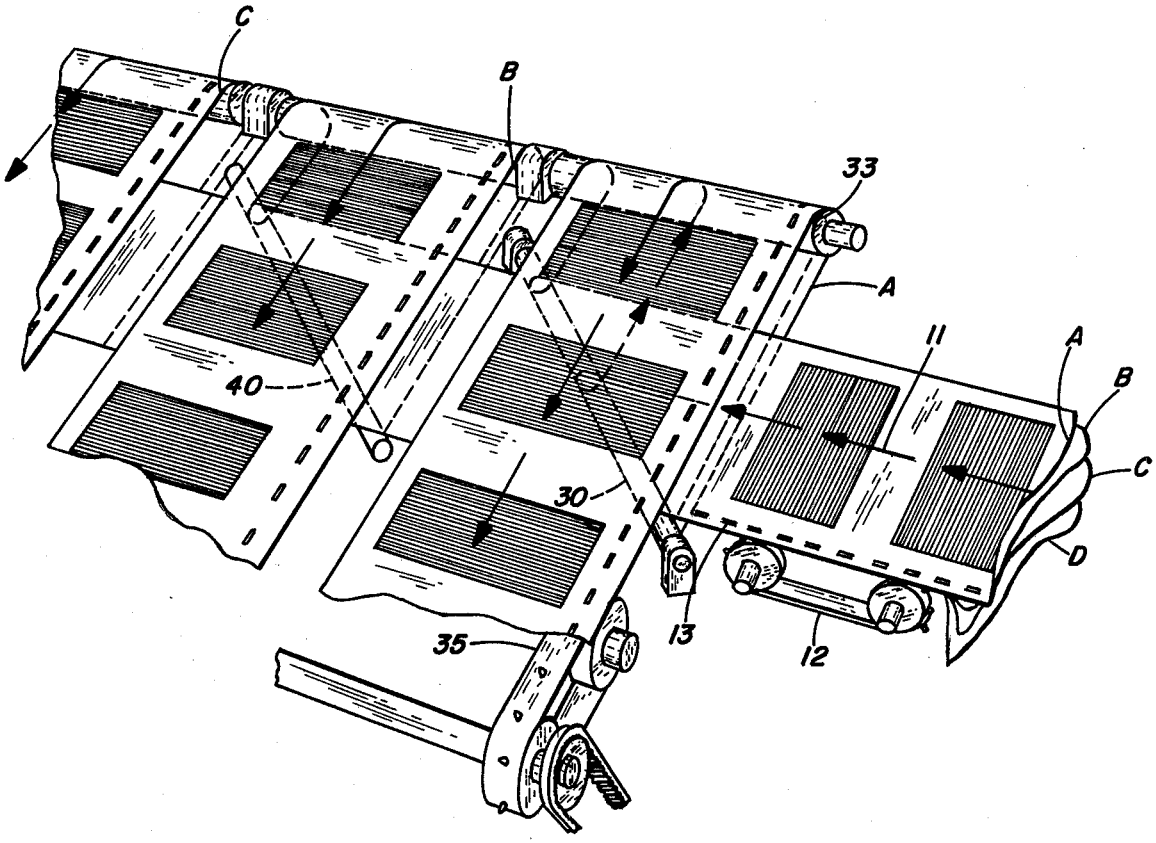
FIG. 4 is a perspective view made on a scale larger than that shown in FIG. 1, to illustrate more clearly the arrangement shown in FIG. 1.

The assembly shown in FIG. 1 is illustrative of one form by means of which the invention may be carried out. In such illustration, the delivery end of a rotary printing press is designated in general at 10 on which business forms are printed upon multiple copy webs in a machine, such as that shown in U.S. Pat. No. 3,147,006 issued on Sept. 1, 1964. In such machine, the printed webs of paper are moved in unison from supply rolls and in superposed relationship in a straight line direction, as indicated by the arrow 11 in FIG. 1, by a pinned belt 12 which engages a row of holes 13 along one edge of the paper webs. For the purpose of illustration, the drawings show 4 paper webs which are designated as A, B, C and D respectively, but the invention is capable of functioning satisfactorily for separating and stacking as many webs as the printing machine is capable of producing.

In addition to the printing of the forms, the webs may be simultaneously processed while they are moving in unison through the machine 10 for such operation as file hole punching, and cross perforating, so that by the time the webs reach the delivery end of the machine, they are in condition for separation and processing into separate stacks. Such operation is shown in the respective drawings wherein dual folders 20 and 21 are shown as being positioned at the front of the machine and immediately adjacent the delivery end thereof. The folder 20 receives the top web A and second web B and processes them by folding and forming them into the stacks 22 and 23 respectively, while the folder 21 processes the third and fourth webs and folds them and forms them into stacks 24 and 25 respectively.

The operation by means of which one form of the invention may be carried out includes a bar 30 which is mounted upon a frame 31 and is disposed at an angle of about 45° to the direction of travel 11 of the webs. The bar engages the bottom face of the top web A and separates it from the superposed webs by turning it 90° for movement rearwardly of the machine until it clears the rearward edge of the webs. A second bar 33, which is also supported on the frame 31 and which has its axis extending in a direction parallel to the direction of travel 11 of the webs engages the unprinted side of the web A and turns it 180° for movement in a direction toward the front of the machine and into the folder 20 where the web can be zigzag folded as one processing operation and then formed into a stack 22 as another processing operation. During such movement, the web A is propelled by a chain belt 35 which is synchronized for movement with the belt 12 and which has its pins engaging the row of holes 13 on the web A. Thus, the web is moved smoothly and directly into the folder.

The arrangement described for turning the top web A and moving it into the folder is duplicated for the webs B, C and D respectively, by progressively engaging and turning the second web B, the third web C, and the bottom web D around bars 40, 41 and 42 respectively. The respective webs B, C and D are then turned for movement in the direction toward the front of the machine by bars 45, 46 and 47 respectively, and are folded and then formed into stacks 23, 24 and 25 respectively. During such movement, the webs are engaged by pinned belts 50, 51 and 52 respectively, which are constructed in a manner similar to the pinned belt 35 and are moved synchronously with it. Such movement may be acomplished by suitable chain drives 60 and 61 which are driven by an electric motor 65.

Although the invention has been described as having been carried out by moving the webs first in a direction rearwardly of the machine and 90°, or normal to the direction of movement of the webs through the machine, and then 180° forwardly of the machine, it is to be understood that such arrangement is a preferred embodiment, because the webs are contacted on the unprinted side as the direction of travel is turned during the course of movement of the webs into the folders. Such arrangement is advantageous in that the printed side of each web is visible as it moves into the folder, thereby making any defect in the processing operations readily discernible to the operator. Additionally, by engaging the webs on the unprinted side, there is less danger of smearing the ink on the printed portions as the webs move rapidly through the machine. It is, however, within the scope of the invention to make only one turn of the webs in a direction normal to the direction of travel through the machine, but in such arrangement, it is to be understood that only the unprinted side of the forms would be visible as they moved into the folders. Consequently, if the ink should be smeared by contact of the webs with the deflecting bars, such defect would not become known until the forms have left the possession of the manufacturer and are ready for processing by the ultimate user of the forms. Where only a single turn is utilized, it is to be understood that the bars 30, 40, 41 and 42 would each be positioned on the frame with its axis disposed at a right angle to that shown in FIG. 1.

The method of the present invention is advantageous in that the webs can be cross-perforated individually instead of simultaneously. Cross-perforating simultaneously becomes increasingly difficult as the number of webs increase, whereas individual cross-perforating assures a more satisfactory product. Such operation may be performed on the respective webs at any one of several locations after the webs have left the press, but the preferred location is at the top of the folder where a drive is located conveniently. In FIG. 1, a cross-perforator is indicated diagrammatically for the webs A to D at 26, 27, 28 and 29 respectively, the cross-perforators 26 and 27 being shown on the dual folder 20 and the cross-perforators 28 and 29 being shown on the dual folder 21. It is to be understood that such cross-perforators are operated in timed relationship to the pinned belts 12, 35, 50, 51 and 52 respectively.

A further advantage of the present invention is that, at the rate of 1,000 ft. per min. of web travel through the machine, only 2,000 forms per minute can be printed on a two-wide folder, whereas the present invention enables one to stack as many superimposed webs as can be printed on the machine. Thus, at the same rate of web travel and processing four webs at a time, the production would be 4,000 forms per minute. Another advantage is the shortening of the overall dimension of the machine. An important reason for the successful operation of the method is that the turning bars are located between the pinned belt 12 and the pinned belts 35, 50, 51 and 52 respectively, with the result that the webs float around the bars in a smooth continuous operation.

I claim:

1. A method of producing a plurality of processed paper web units of business forms in a continuous operation from a plurality of supply rolls of unprocessed paper webs comprising, advancing the webs from the respective supply rolls along a generally horizontal processing path wherein said webs are simultaneously and continuously processed, performing a first processing step simultaneously on all of said webs while they are in superposed relation and are moving continuously along said path, separating the processed webs while they are continuously moving and imparting a first change at spaced points in the direction of movement of the respective webs which is substantially at a right angle to the direction of travel during the first processing step, whereby the webs are then moving in side-by-side spaced relationship in substantially a common plane but at substantially a right angle to said path, performing a zig-zag folding operation on said webs while they are continuously moving in said side-by-side spaced relationship whereby stacks of zig-zag folded webs in side-by-side relation on a common front are produced by said folding operation, and said common front extending along a line which is generally parallel to said horizontal processing path for easy takeaway of said stacks.

2. A method according to claim 1, comprising imparting a second change of direction of movement of the webs prior to the folding operation on said webs.

3. A method of producing a plurality of processed paper web units of business forms in a continuous operation from a plurality of supply rolls of unprocessed paper webs comprising, moving the respective webs simultaneously from the respective supply rolls into a horizontal superposed relation in a common direction, with each web having an upper and a lower face, performing a first processing step simultaneously on all of said webs while they are in superposed relation and are moving in the common direction, separating the processed webs while they are continuously moving and imparting a first change at spaced points in the direction of movement of the respective webs, which is substantially at a right angle to the direction of travel during the first processing step, whereby the webs are then moving in side-by-side spaced relationship but at substantially a right angle to said common direction of travel, performing a cross-perforating operation as a second processing step on said webs while they are continuously moving in side-by-side relationship and then performing a third processing step on said webs.

4. An apparatus for making a plurality of processed paper web units of business forms in a continuous operation from a plurality of rolls of unprocessed paper webs comprising in combination, a frame, means on the frame for moving a plurality of webs of paper simultaneously in a continuous motion from said supply rolls into a horizontal superposed relation in a common direction, with each web having an upper and a lower face, means for performing a first processing operation on the webs while they are in said superposed relation and are moving in the common direction, means carried by the frame for separating said webs while they are continuously moving and for imparting a first change, at spaced points, in the direction of movement of the respective webs, which is substantially at a right angle to the direction of travel during the first processing operation, whereby the webs are then moving in side-by-side spaced relationship but at substantially at a right angle to said common direction of travel, of said superposed webs, means for performing a second processing operation on said webs, while they are moving continuously in said side-by-side relationship and, means for reversing the direction of movement of the webs after the first change has been made in the direction of movement of the webs and before the webs are further processed, and means for forming the processed webs into stacks on a line which is offset from but which extends in the same general direction of movement of the superposed webs.

* * * * *